US008270891B2

(12) United States Patent
Ogashiwa

(10) Patent No.: US 8,270,891 B2
(45) Date of Patent: Sep. 18, 2012

(54) DEVELOPER STORAGE UNIT AND IMAGE FORMING APPARATUS

(75) Inventor: Sakae Ogashiwa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 1178 days.

(21) Appl. No.: 12/076,582

(22) Filed: Mar. 20, 2008

(65) Prior Publication Data

US 2008/0240779 A1 Oct. 2, 2008

(30) Foreign Application Priority Data

Mar. 28, 2007 (JP) ..... 2007-083822

(51) Int. Cl.
*G03G 21/12* (2006.01)

(52) U.S. Cl. ..... 399/360

(58) Field of Classification Search ..... 399/120, 399/343, 358–360; 222/DIG. 1
See application file for complete search history.

(56) References Cited

U.S. PATENT DOCUMENTS

| | | | | |
|---|---|---|---|---|
| 4,990,964 | A * | 2/1991 | Kraehn | 399/261 |
| 6,014,541 | A * | 1/2000 | Kato et al. | 399/358 |
| 7,054,591 | B1 * | 5/2006 | Wilhelm et al. | 399/360 |
| 7,149,467 | B2 * | 12/2006 | Stickler et al. | 399/358 |

FOREIGN PATENT DOCUMENTS

JP 05-066700 3/1993

* cited by examiner

*Primary Examiner* — Hoan Tran
(74) *Attorney, Agent, or Firm* — Kubotera & Associates, LLC

(57) ABSTRACT

An image forming apparatus includes a developer storage portion for storing developer. The image forming apparatus further includes a developer supply portion for supplying developer through an opening portion of the developer storage portion. When a closing member is attached to the developer storage portion for closing the opening portion, the developer supply portion is separated from the developer storage portion.

22 Claims, 18 Drawing Sheets

DEVELOPER STORAGE UNIT AND IMAGE FORMING APPARATUS

BACKGROUND OF THE INVENTION AND RELATED ART STATEMENT

The present invention relates to a developer storage unit and an image forming apparatus.

In a conventional image forming apparatus such as a electro-photographic color printer, image forming units corresponding to each color are arranged in a tandem type along a transportation path of a sheet, so that four types of toner are sequentially overlapped and transferred to the sheet, thereby forming a color image.

Each of the image forming units includes a photosensitive drum and a toner image forming unit. The toner image forming unit has a cleaning unit, a charge roller, an exposure unit, and a developing roller arranged round the photosensitive drum. Each of the image forming units further includes a transfer roller arranged to face the photosensitive drum with a transfer belt inbetween, and a toner image transfer unit having a transfer belt cleaning unit.

Further, the image forming apparatus includes a toner discharge portion for transporting unnecessary toner discharged from the toner image transfer unit; a sheet supply tray for supplying the sheet; a transportation roller for transporting the sheet; a fixing unit for fixing the toner image transferred to the sheet; and a discharge tray for placing the sheet with the toner image transferred thereon discharged from an image forming apparatus main body Further, the image forming apparatus includes a waste toner collection container as a waste toner storage unit detachably attached to the image forming apparatus main body for storing waste toner transported with the toner discharge portion. The waste toner collection container has an opening portion for receiving waste toner transported from the toner discharge portion.

When the waste toner collection container is filled with waste toner, the waste toner collection container is removed, so that the waste toner collection container is replaced with a new one (refer to Patent Reference).

Patent Reference Japanese Patent Publication No. 05-66700

In the conventional waste toner storage unit, when the waste toner collection container is replaced, the waste toner collection container is detached from the image forming apparatus main body, and a lid is attached to the opening portion before discarding the waste toner collection container. Accordingly, when the waste toner collection container is detached from the image forming apparatus main body, waste toner may spill from the opening portion.

Further, the lid to be attached to the opening portion is included in a package of the waste toner collection container. Accordingly, the lid may be lost before attaching the opening portion.

In the view of the problems described above, an object of the present invention is to provide a developer storage unit and an image forming apparatus capable of solving the problems of the conventional waste toner storage unit. In the developer storage unit and the image forming apparatus of the present invention, a closing member is held on the developer storage unit. Accordingly, it is possible to easily and securely close an opening portion without losing the closing member and spilling waste toner from the opening portion when the developer storage unit is replaced.

Further objects and advantages of the invention will be apparent from the following description of the invention.

SUMMARY OF THE INVENTION

In order to attain the objects described above, according to a first aspect of the present invention, an image forming apparatus includes a developer storage portion for storing developer. The image forming apparatus further includes a developer supply portion for supplying developer through an opening portion of the developer storage portion. When a closing member is attached to the developer storage portion for closing the opening portion, the developer supply portion is separated from the developer storage portion.

According to a second aspect of the present invention, a developer storage unit for storing developer includes an opening portion; a closing member for closing the opening portion; and a holding portion for holding the closing member.

In the image forming apparatus of the present invention, the closing member is held on the developer storage portion for closing the opening portion. Accordingly, it is possible to easily and securely close the opening portion without losing the closing member and spilling waste toner from the opening portion when the developer storage portion is replaced.

DETAILED DESCRIPTION OF THE PREFERRED EMBODIMENTS

Hereunder, embodiments of the present invention will be explained with reference to the accompanying drawings.

First Embodiment

Figure 1:
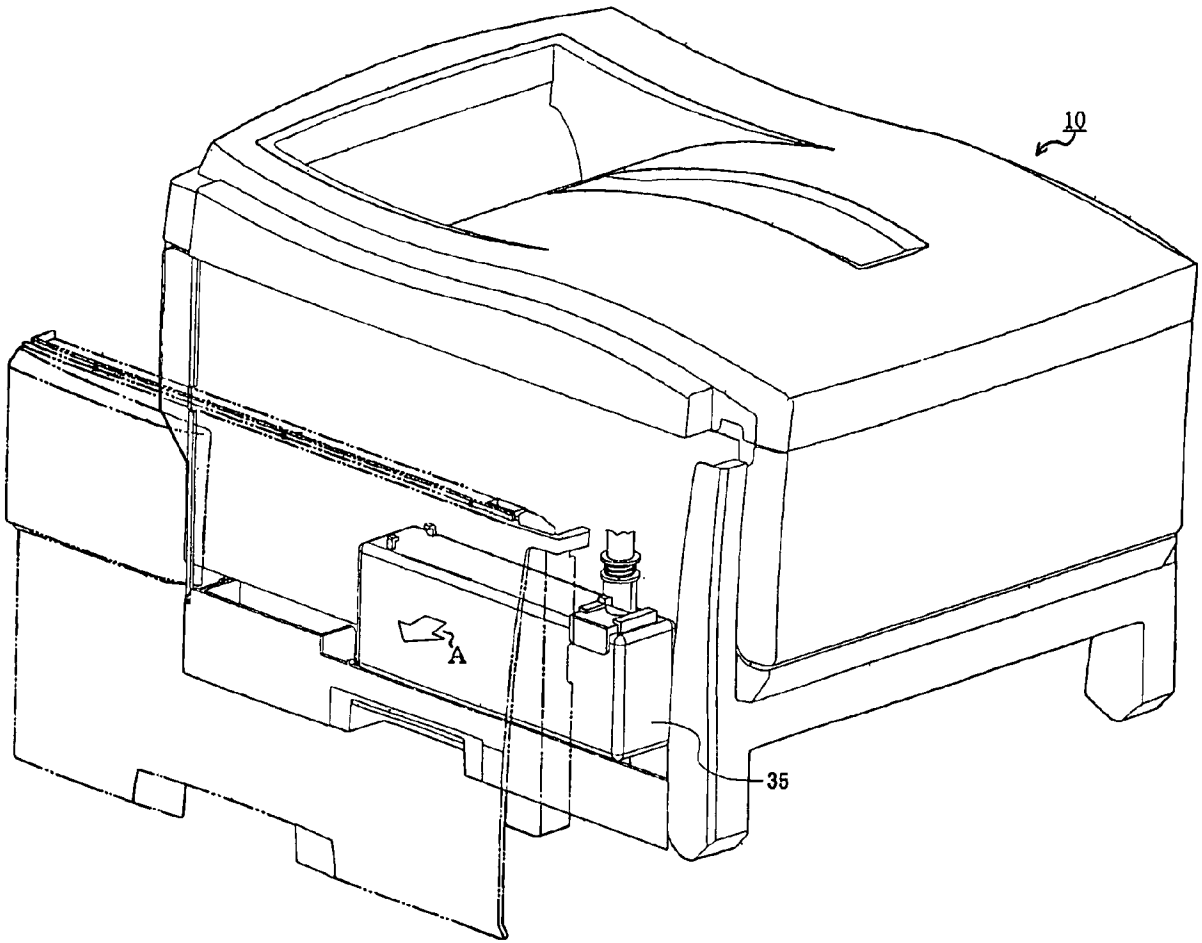
FIG. 1 is a perspective view showing an image forming apparatus and a waste toner collection container with a lid attached thereto according to a first embodiment of the present invention.
Figure 2:
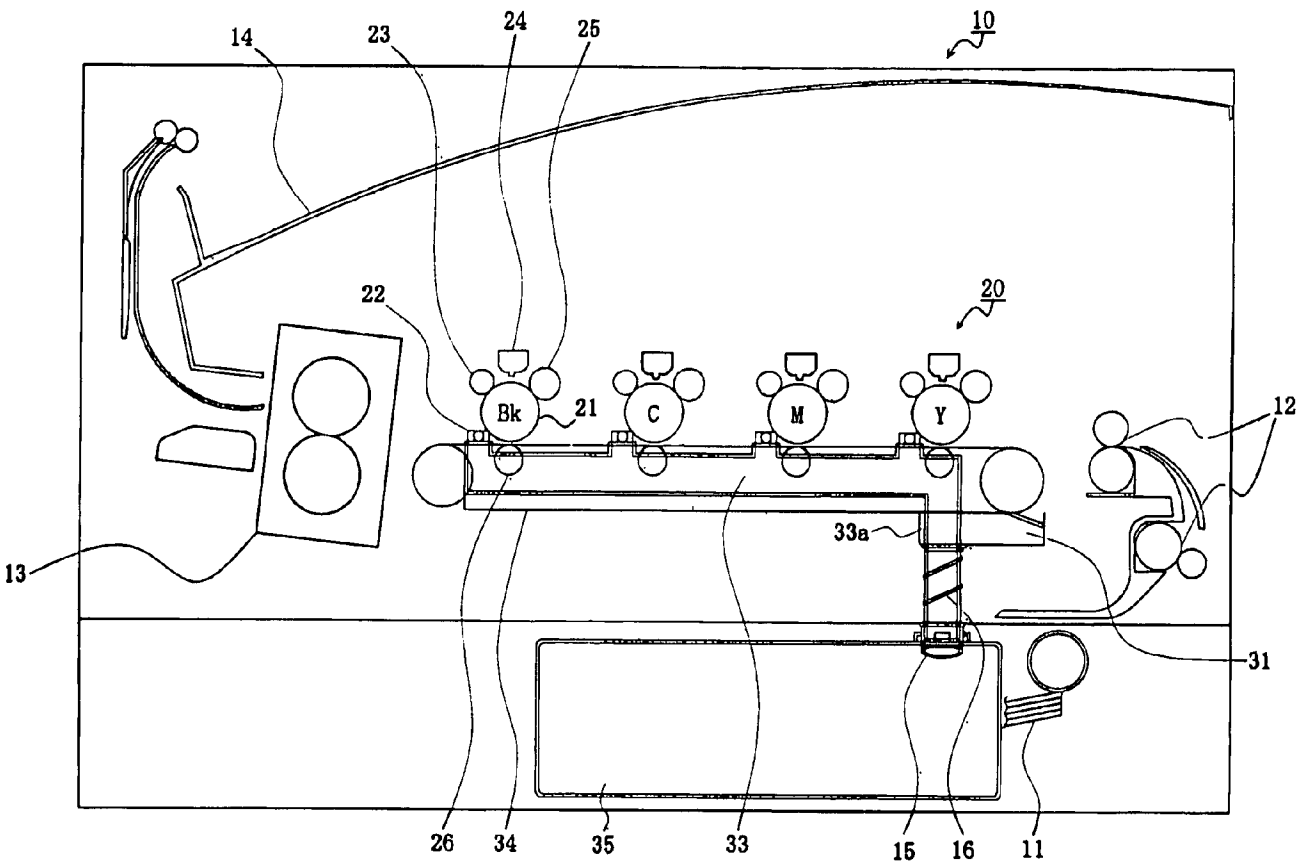
FIG. 2 is a schematic sectional view showing the image forming apparatus according to the first embodiment of the present invention.

A first embodiment of the present invention will be explained. FIG. 1 is a perspective view showing an image forming apparatus 10 and a waste toner collection container 35 with a lid attached thereto according to a first embodiment of the present invention. FIG. 2 is a schematic sectional view showing the image forming apparatus 10 according to the first embodiment of the present invention.

Figure 3:
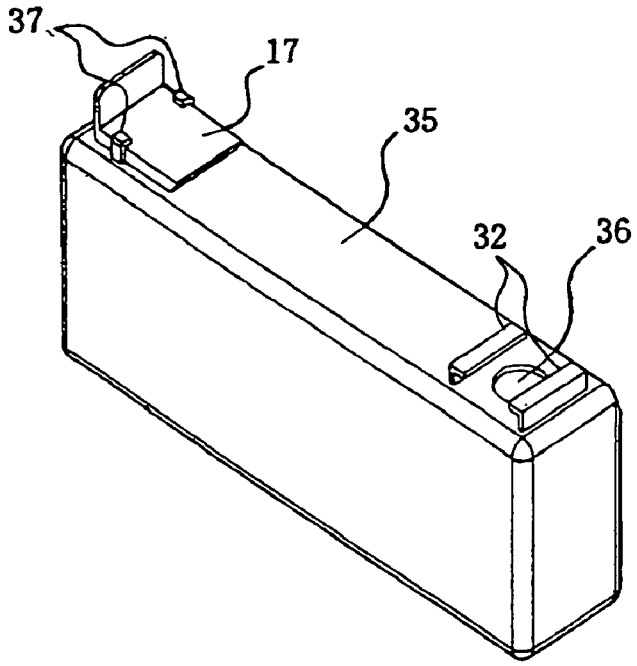
FIGS. 3(*a*) and 3(*b*) are perspective views showing the waste toner collection container according to the first embodiment of the present invention, wherein FIG. 3(*a*) is a view showing the waste toner collection container with the lid held thereon, and FIG. 3(*b*) is a view showing the waste toner collection container with the lid attached thereto.
Figure 3:
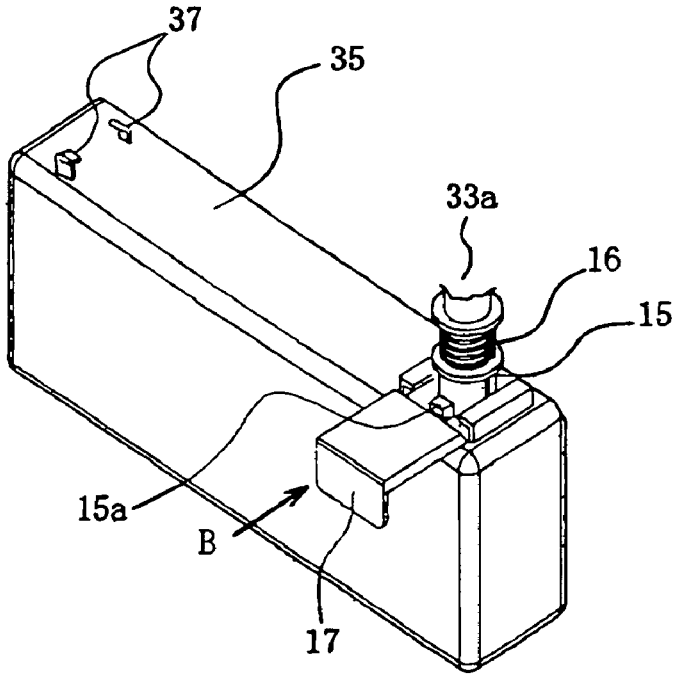

FIGS. 3(*a*) and 3(*b*) are perspective views showing the waste toner collection container 35 according to the first embodiment of the present invention. More specifically, FIG. 3(*a*) is a view showing the waste toner collection container 35 with the lid 17 held thereon, and FIG. 3(*b*) is a view showing the waste toner collection container with the lid 17 attached thereto.

In the embodiment, the image forming apparatus 10 is an electro-photographic printer, a facsimile, a copier, a multi-function product having functions of a printer, a facsimile, and a copier, and may be any type of image forming apparatus. In the embodiment, the image forming apparatus 10 is an electro-photographic color printer of the tandem type.

In the image forming apparatus 10, image forming units 20 corresponding to four colors such as yellow, magenta, cyan, and black are arranged along a transportation path of a sheet in tandem. A transportation belt 34 is extended and rotated with a plurality of rollers, so that the transportation belt 34 transports the sheet. Four types of toner are sequentially overlapped and transferred to the sheet, thereby forming a color image. Note that the image forming units 20 have a substantially identical configuration, and the image forming unit 20 corresponding to black will be explained as a representative.

In the embodiment, the image forming unit 20 includes a photosensitive drum 21; and a toner image forming unit having a photosensitive drum cleaning unit 22, a charge roller 23, an exposure unit 24, and a developing roller 25 arranged round the photosensitive drum 21. The image forming unit 21 further includes a transfer belt 34, a transfer roller 26 arranged to face the photosensitive drum 21 with the transfer belt 34 inbetween, and a transfer belt cleaning unit 31.

Further, the image forming apparatus 10 includes a toner discharge portion 33 for discharging unnecessary toner; the waste toner collection container 35 as a developer storage unit or a developer storage unit for storing unnecessary toner thus discharged; a sheet supply tray 11 for supplying the sheet; a transportation roller 12 for transporting the sheet; a fixing unit 13 for fixing the toner image transferred to the sheet; and a discharge tray 14 for placing the sheet with the toner image transferred thereon discharged form a main body of the image forming apparatus 10.

In the embodiment, blades are attached to the photosensitive drum cleaning unit 22 and the transfer belt cleaning unit 31 for removing unnecessary toner, respectively.

When unnecessary toner is discharged from the photosensitive drum cleaning unit 22 and the transfer belt cleaning unit 31, the toner discharge portion 33 collects and discharges unnecessary toner. Accordingly, unnecessary toner moves into and is retained in the waste toner collection container 35 detachably attached to the main body of the image forming apparatus 10.

As shown in FIG. 1, after a decorative plate is removed from the main body of the image forming apparatus 10, the waste toner collection container 35 may be moved in an arrow direction A, so that the waste toner collection container 35 can be detached from the main body of the image forming apparatus 10.

As shown in FIG. 3(*a*), the waste toner collection container 35 has an opening portion 36 at an end of an upper plate thereof, so that unnecessary toner flows therein from the toner discharge portion 33. Further, the waste toner collection container 35 has guides 32 on both sides of the opening portion 36 for guiding the lid 17 as a closing member attached to the waste toner collection container 35.

Further, the waste toner collection container 35 has holding claw portions 37 at the other end of the upper plate thereof for holding the lid 17. As shown in FIG. 3(*a*), the lid 17 engages with the holding claw portions 37, so that the lid 17 is held on the waste toner collection container 35. Accordingly, it is possible to prevent the lid 17 from being lost.

As shown in FIG. 2, a discharge pipe portion 33*a* in a pipe shape extending downwardly is integrally formed in the toner discharge portion 33 in a lower surface thereof at an end portion thereof. A discharge toner guide 15 as a developer supply portion is attached to the discharge pipe portion 33*a* at a lower end portion thereof, so that the discharge toner guide 15 can slide in a vertical direction.

As shown in FIG. 3(*b*), when the discharge toner guide 15 slides downwardly, a lower end portion of the discharge toner guide 15 is inserted into the opening portion 36. A coil spring 16 is disposed at a lower portion of the discharge pipe portion 33*a* for urging the discharge toner guide 15 downwardly. A claw portion 15*a* is formed at the lower end portion of the discharge toner guide 15.

Figure 4:
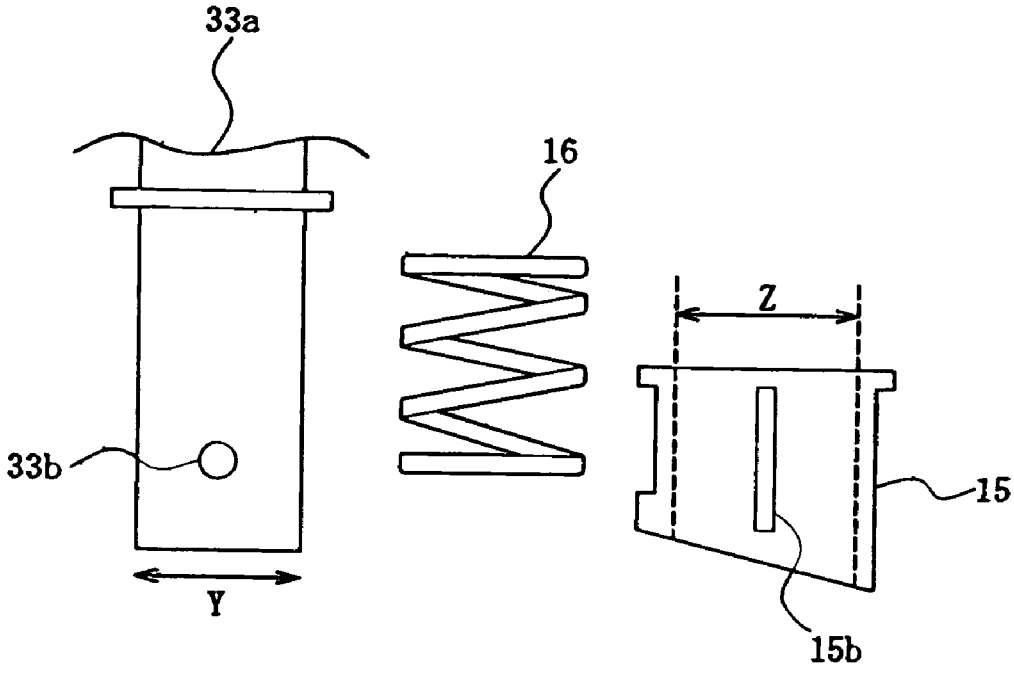
FIG. 4 is an exploded view showing a discharge toner guide according to the first embodiment of the present invention.

In the embodiment, as shown in FIG. 4, a guide protrusion 33*b* is formed on a side surface of the discharge pipe portion 33*a* near the lower end portion thereof. A guide groove 15*b* extending in a vertical direction is formed in a side surface of the discharge toner guide 15. The lower portion of the discharge pipe portion 33*a* has an outer diameter Y smaller than an inner diameter Z of the discharge toner guide 15. Accordingly, when the lower portion of the discharge pipe portion 33*a* is inserted into the discharge toner guide 15, and the guide protrusion 33*b* engages the guide groove 15*b*, the discharge toner guide 15 is fitted to the discharge pipe portion 33*a* not to be rotatable and to be slidable in the vertical direction over a specific range. Note that the lower end portion of the discharge toner guide 15 is formed in a slant surface as a slant portion of a cylindrical member cut obliquely.

In the embodiment, the discharge pipe portion 33*a* and the discharge toner guide 15 extend downwardly from the toner discharge portion 33 toward the opening portion 36. Alternatively, the discharge pipe portion 33*a* and the discharge toner guide 15 may extend sideways from the toner discharge portion 33.

As shown in FIG. 3(*b*), when the waste toner collection container 35 is detached from the main body of the image forming apparatus 10 to replace the waste toner collection container 35 and the likes, the lid 17 moves in an arrow direction B, and the upper plate of the waste toner collection container 35 slides along the guides 32, thereby closing the opening portion 36. Accordingly, when the waste toner collection container 35 is detached from the main body of the image forming apparatus 10, it is possible to prevent unnecessary toner retained in the waste toner collection container 35 from spilling from the opening portion 36.

Figure 5:
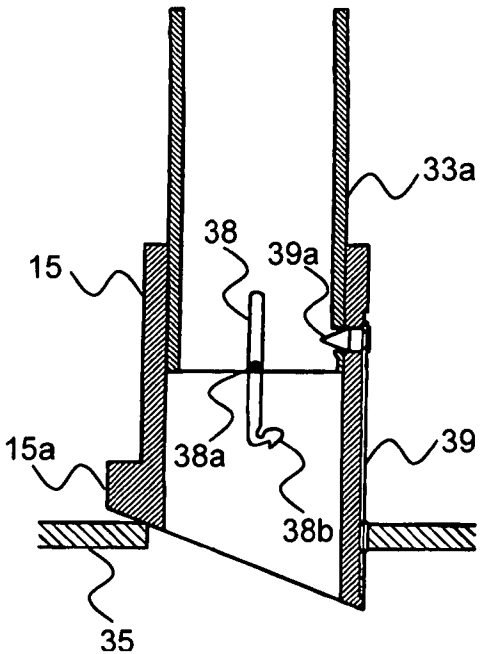
FIGS. 5(*a*) to 5(*c*) are sectional views showing the discharge toner guide according to the first embodiment of the present invention, wherein FIG. 5(*a*) is a view showing the discharge toner guide in which the lid closes an opening portion, FIG. 5(*b*) is a view showing the discharge toner guide detached from the opening portion, and FIG. 5(*c*) is a view showing the discharge toner guide inserted into the opening portion.
Figure 5:
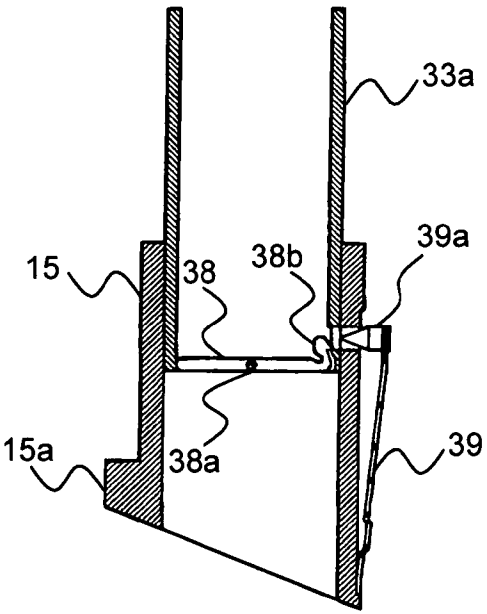
Figure 5:
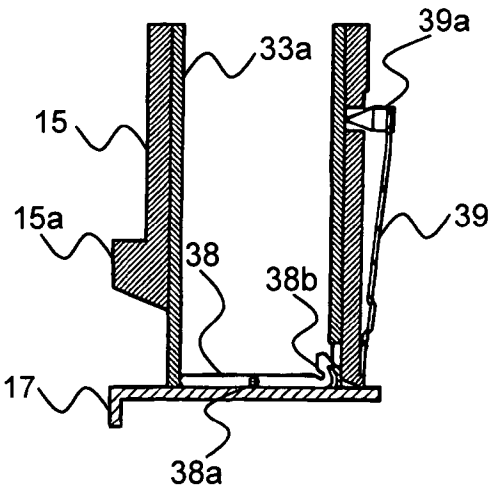

A configuration of the discharge toner guide 15 will be explained in detail next. FIGS. 5(*a*) to 5(*c*) are sectional views showing the discharge toner guide 15 according to the first embodiment of the present invention. More specifically, FIG. 5(*a*) is a view showing the discharge toner guide 15 in which the lid 17 closes the opening portion 36, FIG. 5(*b*) is a view showing the discharge toner guide 15 detached from the opening portion 36, and FIG. 5(*c*) is a view showing the discharge toner guide 15 inserted into the opening portion 36.

In the embodiment, a shutter member 38 with a plate shape is attached to the lower end portion of the discharge pipe portion 33*a* to be rotatable. In the shutter member 38, pivot portions 38*a* formed near both ends of a center line of the shutter member 38 are fixed to the lower end portion of the discharge pipe portion 33*a*, so that the shutter member 38 rotates around the pivot portions 38*a*. Further, in the shutter member 38, an engagement portion 38*b* is formed on a straight line perpendicular to a straight line between the pivot portions 38*a*. The engagement portion 38*b* engages an inner surface of the lower portion of the discharge pipe portion 33*a*, so that the lower portion of the discharge pipe portion 33*a* is closed.

In the embodiment, a plate member 39 formed in a cantilever shape is attached to an outer wall of the discharge toner guide 15 to be rotatable. The plate member 39 has a lower edge fixed to a lower edge of the outer wall of the discharge toner guide 15 and an upper edge as a free end. A protruding portion 39*a* protruding toward a center of the discharge toner guide 15 is attached to the free end. A distal end of the protruding portion 39*a* enters a hole formed in the discharge toner guide 15.

As described above, when the waste toner collection container 35 is detached from the main body of the image forming apparatus 10, the lid 17 slides on the upper plate of the waste toner collection container 35 along the guides 32, thereby closing the opening portion 36. Accordingly, as shown in FIG. 5(*a*), the lid 17 closes the lower end portion of the discharge pipe portion 33*a* as well.

At this time, the lid 17 pushes the shutter member 38 to rotate around the pivot portion 38*a*, so that the engagement portion 38*b* moves upward and engages the inner surface of the lower portion of the discharge pipe portion 33*a*. Accordingly, the shutter member 38 closes the lower portion of the discharge pipe portion 33*a*.

In this state, the engagement portion 38*b* moves upward and engages the inner surface of the lower portion of the discharge pipe portion 33*a*. Accordingly, the shutter member 38 remains closing the lower portion of the discharge pipe portion 33*a*. As a result, when the waste toner collection container 35 is detached from the main body of the image forming apparatus 10, it is possible to prevent unnecessary toner retained in the waste toner collection container 35 from spilling from the lower portion of the discharge pipe portion 33*a*.

When the waste toner collection container 35 is detached from the main body of the image forming apparatus 10, the discharge toner guide 15 comes off the opening portion 36 of the waste toner collection container 35 to be free. Accordingly, as shown in FIG. 5(*b*), the coil spring 16 pushes the discharge toner guide 15 downwardly with respect to the discharge pipe portion 33*a*.

After a new waste toner collection container 35 is attached to the main body of the sheet supply tray 11, the lower portion of the discharge toner guide 15 is inserted into the opening portion 36 of the waste toner collection container 35. Accordingly, as shown in FIG. 5(*c*), an inner wall of the opening portion 36 presses the plate member 39 against the outer wall of the discharge toner guide 15. As a result, the distal end of the protruding portion 39*a* protrudes into the discharge pipe portion 33*a* through the hole formed in the discharge pipe portion 33*a* and the hole formed in the discharge toner guide 15.

Accordingly, the protruding portion 39*a* disengages the engagement portion 38*b* from the inner surface of the lower portion of the discharge pipe portion 33*a*. As a result, the shutter member 38 rotates around the pivot portion 38*a* with a pushing force of the protruding portion 39*a* with respect to the engagement portion 38*b* and a weight of toner in the discharge pipe portion 33*a*, so that the engagement portion 38*b* moves downwardly. Consequently, the lower portion of the discharge pipe portion 33*a* opens, so that unnecessary toner flows from the toner discharge portion 33 to the waste toner collection container 35. Note that the claw portion 15*a* abuts against the upper plate of the waste toner collection container 35 surrounding the opening portion 36, thereby regulating an amount of the lower portion of the discharge toner guide 15 inserted into the waste toner collection container 35.

An operation of the image forming apparatus 10 will be explained next. First, when the image forming apparatus 10 starts an image forming operation, the sheet stored in the sheet supply tray 11 is separated and transported one by one, and the transportation roller 12 transports the sheet to the transportation belt 34. Then, the transportation belt 34 transports the sheet to pass through the image forming units 20 corresponding to four colors.

In each of the image forming units 20, the charge roller 23 uniformly charges a surface of the photosensitive drum 21. Then, the exposure unit 24 selectively irradiates the surface of the photosensitive drum 21, thereby forming a static latent image thereon. Then, toner is supplied from the developing roller 25 to the surface of the photosensitive drum 21, so that the static latent image is developed to form a toner image.

In the next step, the transfer roller 26 disposed to face the photosensitive drum 21 with the transportation belt 34 inbetween transfers the toner image to the sheet transported with the transportation belt 34. Accordingly, the toner images in four colors are sequentially overlapped and transferred to the sheet transported with the transportation belt 34.

In the next step, the sheet with the toner images transferred thereon is transported to the fixing unit 13, so that the fixing unit 13 fixes the toner images to the sheet. After the toner images are fixed to the sheet, the sheet is discharged from the main body of the image forming apparatus 10 to the discharge tray 14, thereby completing the printing operation to the sheet.

In the embodiment, when unnecessary toner remains on the surface of the photosensitive drum 21 without being transferred, the blade of the photosensitive drum cleaning unit 22 removes unnecessary toner from the surface of the photosensitive drum 21. When unnecessary toner remains on the transportation belt 34 due to insufficient charge or density correction, the blade of the transfer belt cleaning unit 31 removes unnecessary toner from the transportation belt 34. After unnecessary toner is collected to the photosensitive drum cleaning unit 22 and the transfer belt cleaning unit 31, a spiral portion (not shown) disposed in the toner discharge portion 33 transports unnecessary toner to be retained in the waste toner collection container 35.

As unnecessary toner continues to be retained in the waste toner collection container 35, the waste toner collection container 35 is filled with unnecessary toner. When a waste toner sensor (not shown) detects that unnecessary toner retained in the waste toner collection container 35 reaches a specific amount, a control panel and the likes (not shown) of the image forming apparatus 10 displays and notifies that the waste toner collection container 35 is filled with unnecessary toner, thereby prompting a user of the image forming apparatus 10 to replace the waste toner collection container 35. Note that in a normal situation the discharge toner guide 15 is inserted into the waste toner collection container 35. Accordingly, the waste toner collection container 35 is not detached from the main body of the image forming apparatus 10.

Figure 6:
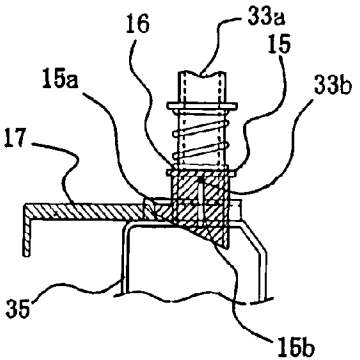
FIGS. 6(*a*) to 6(*e*) are sectional views showing an operation of detaching the waste toner collection container according to the first embodiment of the present invention.
Figure 6:
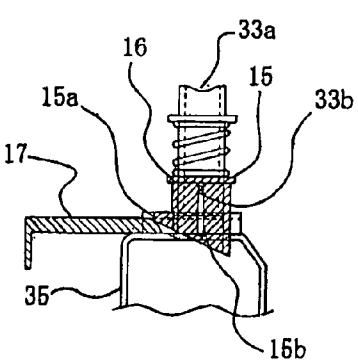
Figure 6:
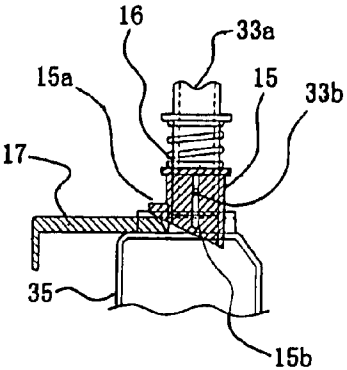
Figure 6:
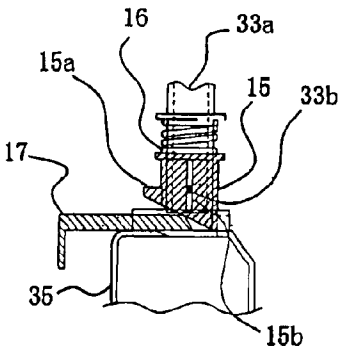
Figure 6:
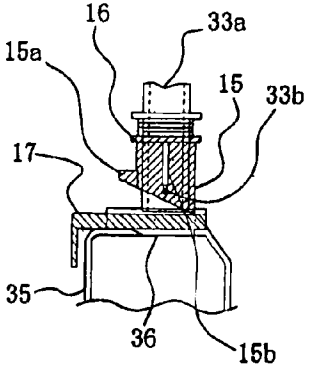

An operation of detaching the waste toner collection container 35 from the image forming apparatus 10 will be explained next. FIGS. 6(*a*) to 6(*e*) are sectional views showing an operation of detaching the waste toner collection container 35 according to the first embodiment of the present invention.

First, the lid 17 held in the waste toner collection container 35 through the engagement with the holding claw portions 37 as shown in FIG. 3(*a*) is removed. Note that the lower portion of the discharge toner guide 15 is inserted into the opening portion 36 as shown in FIG. 3(*b*).

In the next step, the lid 17 slides in the arrow direction B in FIG. 3(*b*), so that the lid 17 slides on the upper plate of the waste toner collection container 35 along the guides 32. Accordingly, as shown in FIG. 6(*a*), a distal end of the lid 17 formed in an inclined surface enters between the upper plate of the waste toner collection container 35 and the claw portion 15*a* of the discharge toner guide 15. As a result, the claw 15*a* moves along the inclined surface of the distal end of the lid 17. As shown in FIG. 6(*b*), the discharge toner guide 15 moves upwardly against an urging force of the coil spring 16.

Figure 16:
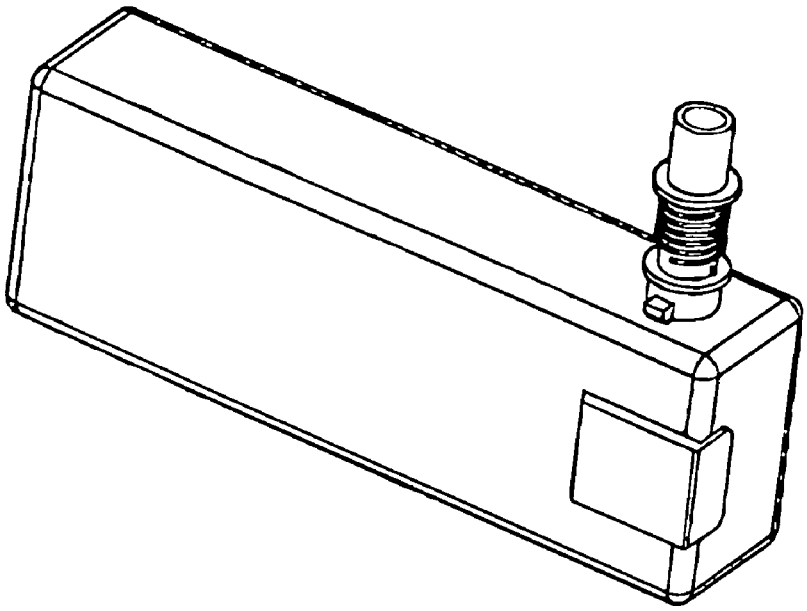
FIGS. 16(*a*) and 16(*b*) are perspective views showing a modified example No. 2 of the lid and the waste toner collection container according to the eighth embodiment of the present invention, wherein FIG. 16(*a*) is a view showing the waste toner collection container with the lid held thereon, and FIG. 16(*b*) is a view showing the waste toner collection container with the lid attached thereto.
Figure 16:
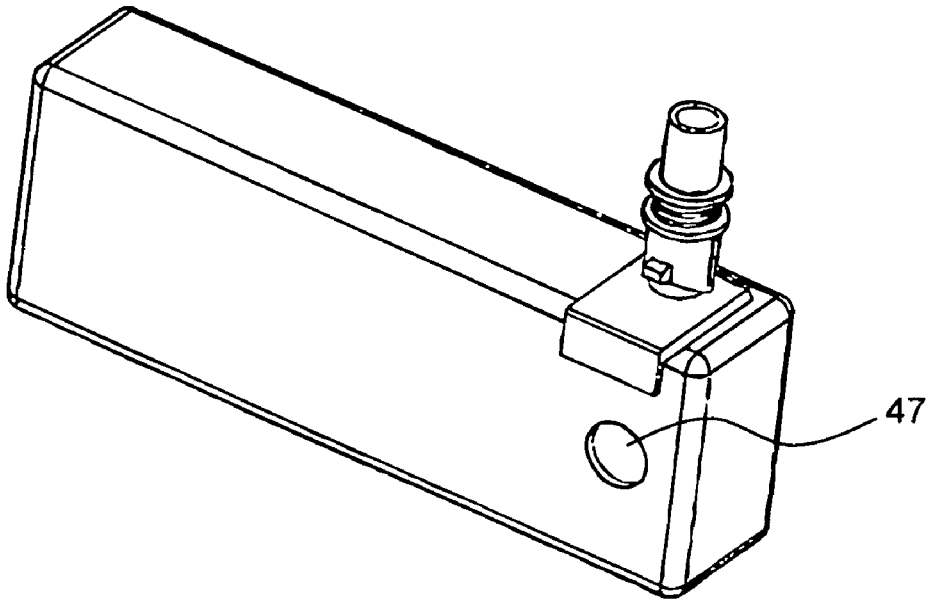

In the next step, as shown in FIG. 16(*c*), an upper edge of the distal end of the lid 17 abuts against the slant surface of the lower portion of the discharge toner guide 15. Accordingly, the lid 17 moves further in the right side in FIG. 6(*c*), the upper edge of the distal end of the lid 17 moves along the slant surface of the lower portion of the discharge toner guide 15, thereby further lifting the discharge toner guide 15 upwardly as shown in FIG. 6(*d*).

When the lid 17 hits the waste toner collection container 35 and stops, as shown in FIG. 6(*e*), the lid 17 closes the opening portion 36 of the waste toner collection container 35. At the same time, the discharge toner guide 15 is separated from the waste toner collection container 35, and moves out of the opening portion 36 to be free. Accordingly, it is possible to detach the waste toner collection container 35 from the main body of the image forming apparatus 10.

As described above, the shutter member 38 rotates with the lid 17 to close the lower portion of the discharge pipe portion 33*a*. Accordingly, it is possible to prevent unnecessary toner retained in the toner discharge portion 33 from leaking and scattering from the lower portion of the discharge pipe portion 33*a*.

In this state, the waste toner collection container 35 slides in the arrow direction A in FIG. 1, so that the waste toner collection container 35 is detached from the main body of the image forming apparatus 10. Accordingly, it is possible to replace the waste toner collection container 35 with a new one.

Figure 7:
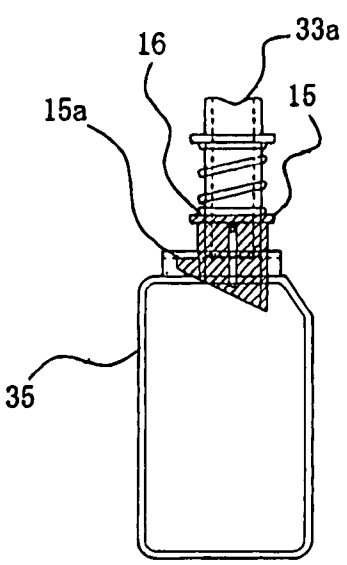
FIGS. 7(*a*) to 7(*d*) are sectional views showing an operation of attaching the waste toner collection container to the image forming apparatus according to the first embodiment of the present invention.
Figure 7:
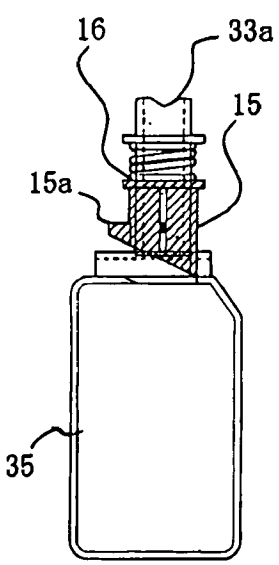
Figure 7:
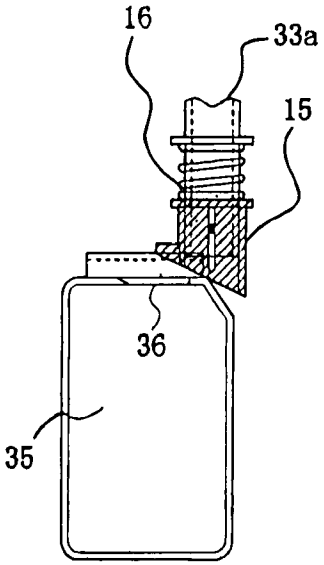
Figure 7:
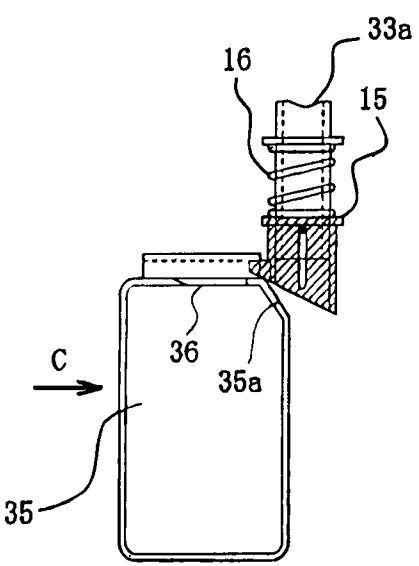

An operation of attaching the waste toner collection container 35 to the image forming apparatus 10 will be explained next. FIGS. 7(*a*) to 7(*c*) are sectional views showing an operation of attaching the waste toner collection container 35 to the image forming apparatus 10 according to the first embodiment of the present invention.

First, as shown in FIG. 7(*a*), in a state that the lid 17 is removed from the opening portion 36, the waste toner collection container 35 moves in an arrow direction C at an attachment position thereof with respect to the main body of the image forming apparatus 10. As a result, an upper edge of a chamfer portion 35*a* of the waste toner collection container 35 abuts against the slant surface of the lower portion of the discharge toner guide 15. When the waste toner collection container 35 moves further to the right direction in FIG. 7(*a*), the upper edge of the chamfer portion 35*a* moves along the slant surface of the lower portion of the discharge toner guide 15. Accordingly, as shown in FIGS. 7(*b*) and 7(*c*), the discharge toner guide 15 moves upward against the urging force of the coil spring 16.

When the discharge toner guide 15 moves relative to the waste toner collection container 35 and reaches above the opening portion 36, the discharge toner guide 15 moves downwardly due to the urging force of the coil spring 16 and enters the opening portion 36. As s result, as described above, the inner wall of the opening portion 36 presses the plate member 39 against the outer wall of the discharge toner guide 15, so that the protruding portion 39*a* disengages the engagement portion 38*b* from the inner surface of the lower portion of the discharge pipe portion 33*a*. Accordingly, the shutter member 38 rotates around the pivot portion 38*a*, so that the lower portion of the discharge pipe portion 33*a* opens. Through the operation described above, the waste toner collection container 35 is attached to the image forming apparatus 10, so that unnecessary toner can flows from the toner discharge portion 33 to the waste toner collection container 35.

As described above, in the embodiment, the discharge toner guide 15 to be inserted into the waste toner collection container 35 is provided with the claw portion 15*a*, and the lower portion of the discharge toner guide 15 becomes the slant surface. Accordingly, it is possible to move the discharge toner guide 15 upward while the lid 17 closes the opening portion 36 of the waste toner collection container 35. As a result, it is possible to close the opening portion 36 of the waste toner collection container 35 with the lid 17 while the waste toner collection container 35 is attached to the main body of the image forming apparatus 10.

With the configuration described above, when the waste toner collection container 35 is detached from the main body of the image forming apparatus 10 and replaced with a new one, it is possible to prevent unnecessary toner retained in the toner discharge portion 33 from leaking and scattering from the opening portion 36.

Further, in the embodiment, the holding claw portions 37 are formed on the upper plate of the waste toner collection container 35 for holding the lid 17. Accordingly, it is possible to attach the waste toner collection container 35 to the main body of the image forming apparatus 10 while the waste toner collection container 35 holds the lid 17, thereby preventing the lid 17 from being lost.

Second Embodiment

A second embodiment of the invention will be described next. Components in the second embodiment similar to those in the first embodiment are designated by the same reference numerals, and explanations thereof are omitted. Further, explanations of operations and effects in the second embodiment similar to those in the first embodiment are omitted.

Figure 8:
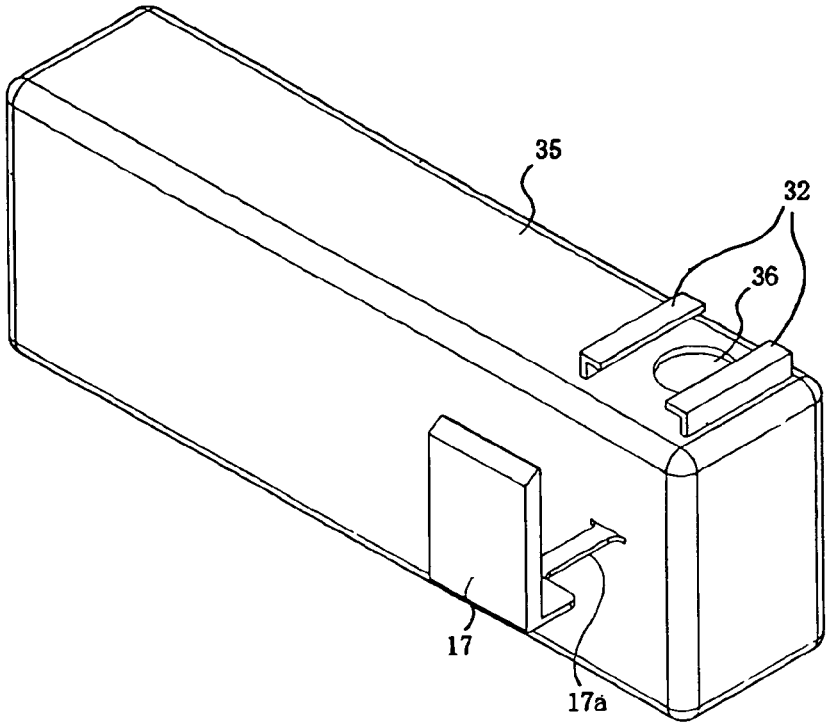
FIGS. 8(*a*) and 8(*b*) are perspective views showing a waste toner collection container according to a second embodiment of the present invention, wherein FIG. 8(*a*) is a view showing the waste toner collection container with a lid held thereon, and FIG. 8(*b*) is a view showing the waste toner collection container with the lid attached thereto.
Figure 8B:
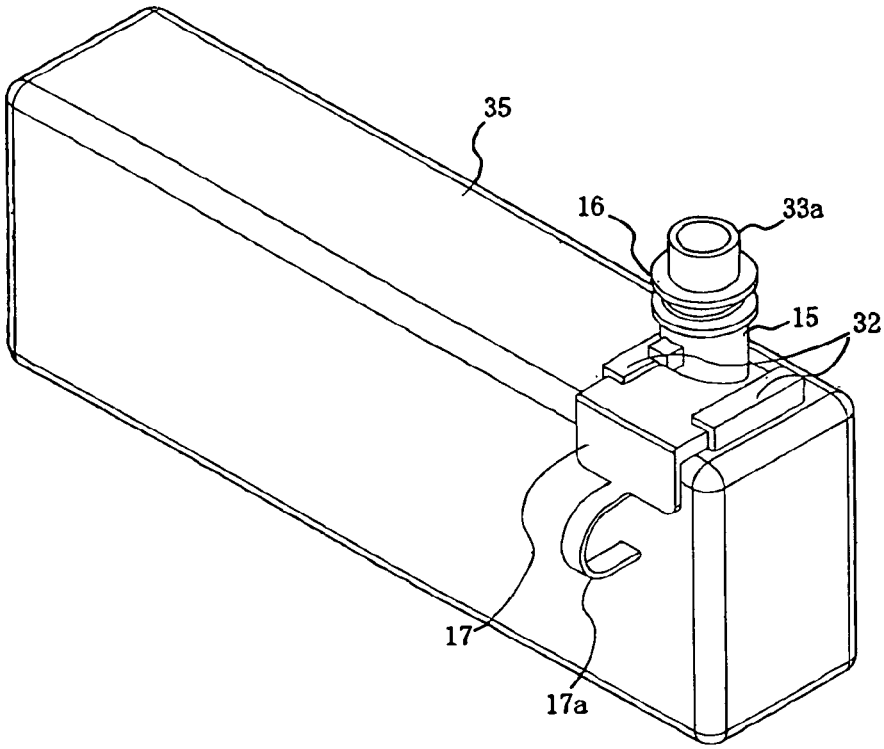

FIGS. 8(*a*) and 8(*b*) are perspective views showing the waste toner collection container 35 according to the second embodiment of the present invention. More specifically, FIG. 8(*a*) is a view showing the waste toner collection container 35 with the lid 17 held thereon, and FIG. 8(*b*) is a view showing the waste toner collection container 35 with the lid 17 attached thereto.

In the second embodiment, as shown in FIG. 8(*a*), the lid 17 is integrated with the waste toner collection container 35, and is connected to the waste toner collection container 35 through a plastic plate 17*a* formed of a bendable thin plate. With the plastic plate 17*a*, it is possible to eliminate the holding claw portions 37 in the first embodiment. Note that the lid 17 may be connected to the waste toner collection container 35 through a separate member.

When the waste toner collection container 35 is detached from the image forming apparatus 10, as shown in FIG. 8(*b*), the plastic plate 17*a* is bent, so that the lid 17 slides on the upper plate of the waste toner collection container 35 along the guides 32, thereby closing the opening portion 36. Other configurations and operations in the second embodiment are similar to those in the first embodiment, and explanations thereof are omitted.

As described above, in the second embodiment, the lid 17 for closing the opening portion 36 is integrated with the waste toner collection container 35. Accordingly, it is possible to securely prevent the lid 17 from being lost.

Third Embodiment

A third embodiment of the invention will be described next. Components in the third embodiment similar to those in the first and second embodiments are designated by the same reference numerals, and explanations thereof are omitted. Further, explanations of operations and effects in the third embodiment similar to those in the first and second embodiments are omitted.

Figure 9:
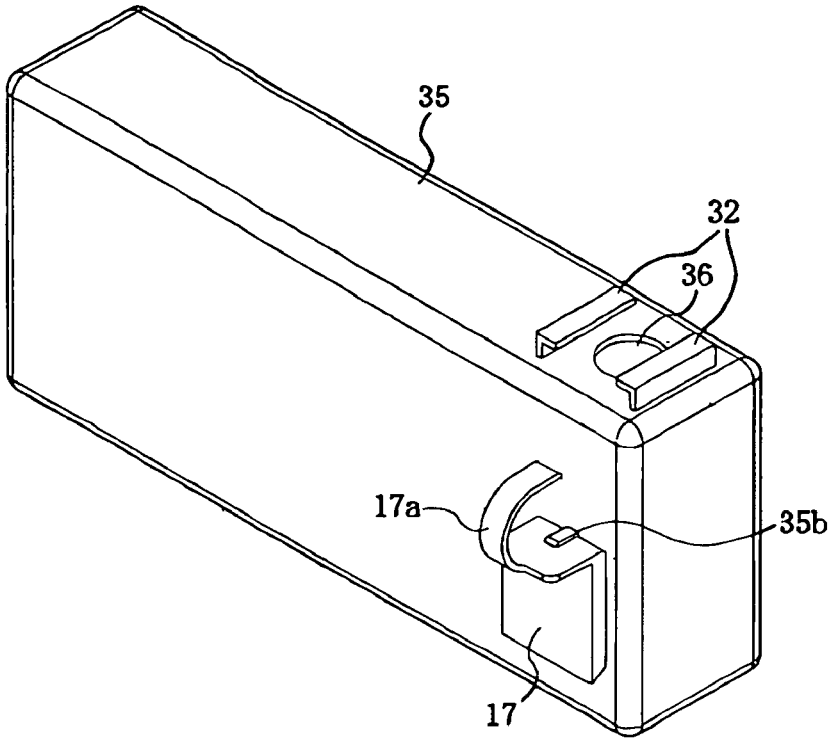
FIGS. 9(*a*) and 9(*b*) are perspective views showing a waste toner collection container according to a third embodiment of the present invention, wherein FIG. 9(*a*) is a view showing the waste toner collection container with a lid held thereon, and FIG. 9(*b*) is a view showing the waste toner collection container with the lid attached thereto.
Figure 9:
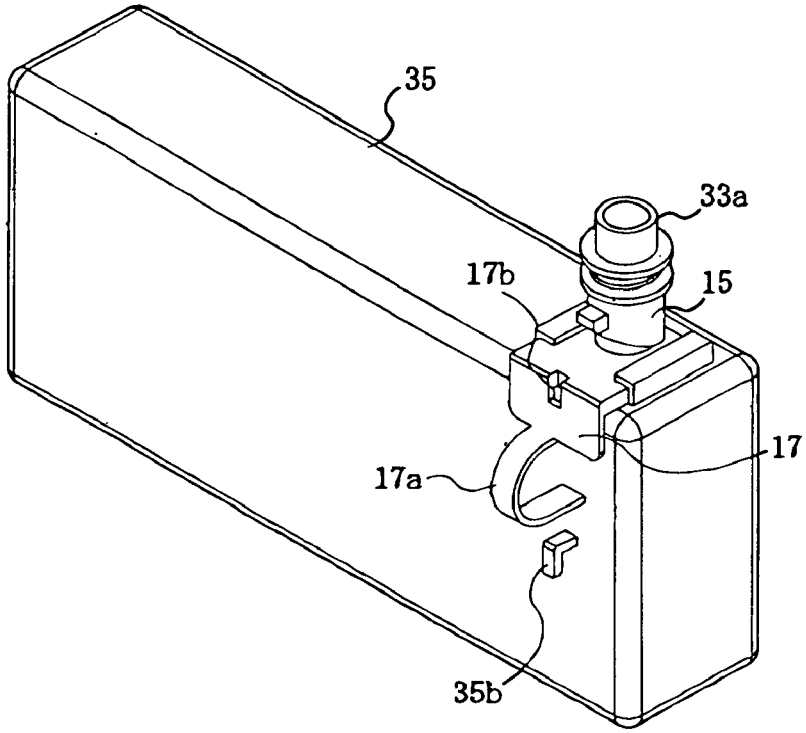

FIGS. 9(*a*) and 9(*b*) are perspective views showing the waste toner collection container 35 according to the third embodiment of the present invention. More specifically, FIG. 9(*a*) is a view showing the waste toner collection container 35 with the lid 17 held thereon, and FIG. 9(*b*) is a view showing the waste toner collection container 35 with the lid 17 attached thereto.

In the third embodiment, similar to the second embodiment, the lid 17 is integrated with the waste toner collection container 35, and is connected to the waste toner collection container 35 through the plastic plate 17*a* formed of a bendable thin plate. Further, as shown in FIG. 9(*b*), an engagement hole 17*b* is formed in the lid 17, and the waste toner collection container 35 is provided with an engagement claw portion 35*b* integrated therewith.

As shown in FIG. 9(*a*), when the lid 17 is not used for closing the opening portion 36, the engagement claw portion 35*b* engages the engagement hole 17*b*, so that the lid 17 is fixed to the waste toner collection container 35. Other configurations and operations in the third embodiment are similar to those in the first and second embodiments, and explanations thereof are omitted.

As described above, in the second embodiment, the engagement claw portion 35*b* of the waste toner collection container 35 engages the engagement hole 17*b* of the lid 17, so that the lid 17 is fixed to the waste toner collection container 35.

In the third embodiment, the plastic plate 17*a* is formed of the bendable thin plate. When the lid 17 closes the opening portion 36, the plastic plate 17*a* is bent. Alternatively, the plastic plate 17*a* may be cut. Further, the plastic plate 17*a* may be configured such that the plastic plate 17*a* can be broken when the plastic plate 17*a* is twisted. Accordingly, when the lid 17 closes the opening portion 36, the plastic plate 17*a* is twisted and broken for use.

Fourth Embodiment

A fourth embodiment of the present invention will be explained next. Components in the fourth embodiment similar to those in the first to third embodiments are designated by the same reference numerals, and explanations thereof are omitted. Further, explanations of operations and effects in the fourth embodiment similar to those in the first to third embodiments are omitted.

Figure 10:
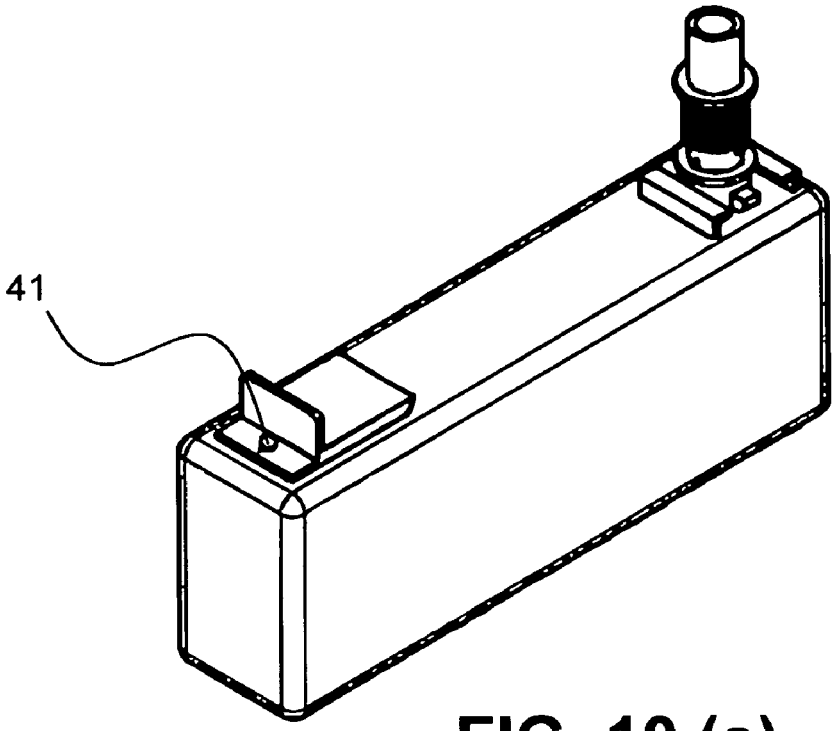
FIGS. 10(*a*) and 10(*b*) are perspective views showing a waste toner collection container according to a fourth embodiment of the present invention, wherein FIG. 10(*a*) is a view showing the waste toner collection container with a lid held thereon, and FIG. 10(*b*) is a view showing the waste toner collection container with the lid attached thereto.
Figure 10:
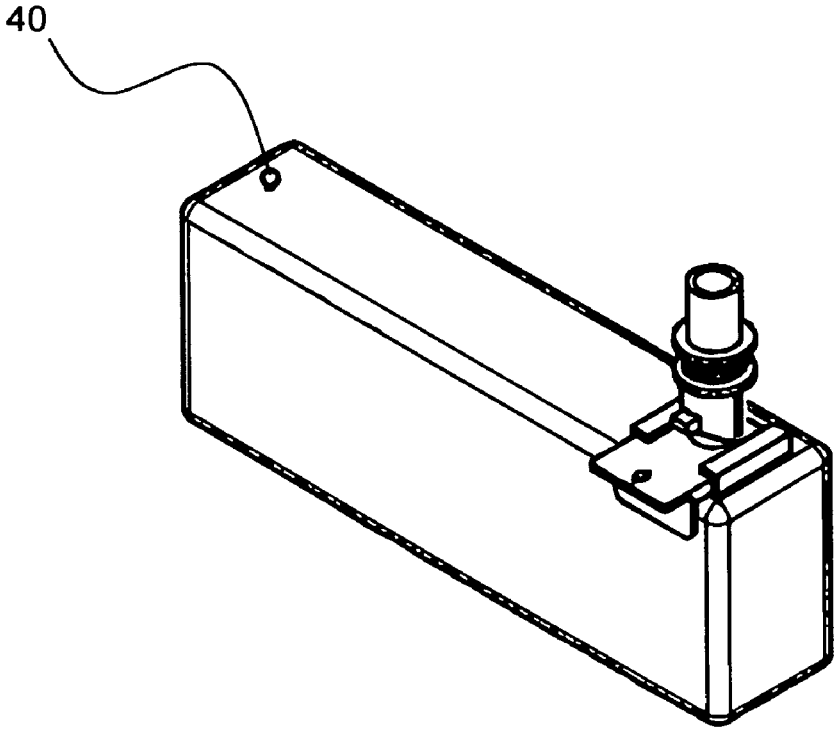

FIGS. 10(*a*) and 10(*b*) are perspective views showing the waste toner collection container 35 according to the fourth embodiment of the present invention. More specifically, FIG. 10(*a*) is a view showing the waste toner collection container 35 with the lid 17 held thereon, and FIG. 10(*b*) is a view showing the waste toner collection container 35 with the lid 17 attached thereto.

In the first embodiment, the lid 17 of the waste toner collection container 35 engages the holding claw portions 37 formed on the waste toner collection container 35. When the lid 17 closes the opening portion 36 of the waste toner collection container 35, the lid 17 is disengaged from the holding claw portions 37 and slides along the guides 32 to close the opening portion 36.

In the second and third embodiments, the lid 17 is connected to the waste toner collection container 35, and may be connected to the waste toner collection container 35 through various manners.

In the fourth embodiment, as shown in FIG. 10(*b*), a protrusion 40 is formed on the upper plate of the waste toner collection container 35 for engaging the lid 17. As shown in FIG. 10(*a*), a through hole 41 is formed in the lid 17 for engaging the protrusion 40. When the lid 17 closes the opening portion 36 of the waste toner collection container 35, the lid 17 is removed from the protrusion 40 to close the opening portion 36 in a method similar to that in the first embodiment.

Fifth Embodiment

A fifth embodiment of the present invention will be explained next. Components in the fifth embodiment similar to those in the first to fourth embodiments are designated by the same reference numerals, and explanations thereof are omitted. Further, explanations of operations and effects in the fifth embodiment similar to those in the first to fourth embodiments are omitted.

Figure 11:
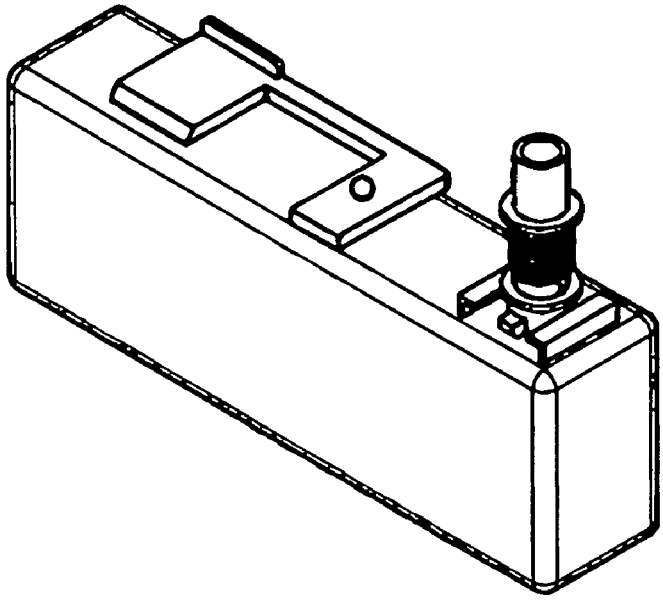
FIGS. 11(*a*) and 11(*b*) are perspective views showing a waste toner collection container according to a fifth embodiment of the present invention, wherein FIG. 11(*a*) is a view showing the waste toner collection container with a lid held thereon, and FIG. 11(*b*) is a view showing the waste toner collection container with the lid attached thereto.
Figure 11:
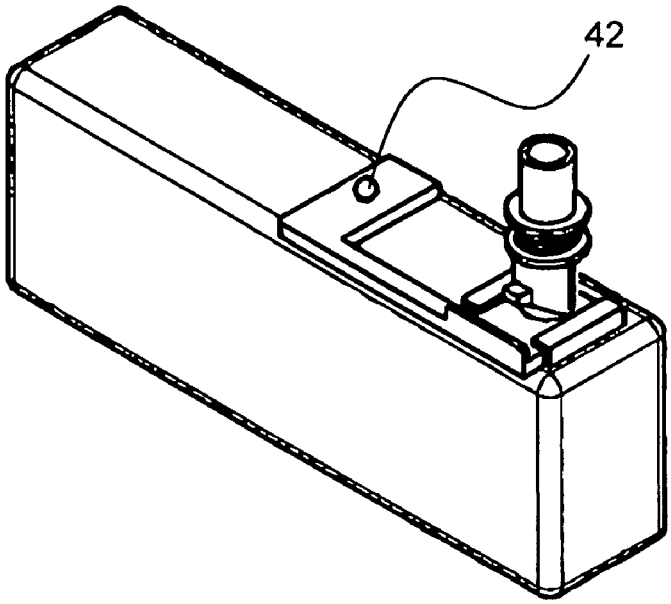

FIGS. 11(*a*) and 11(*b*) are perspective views showing the waste toner collection container 35 according to the fifth embodiment of the present invention. More specifically, FIG. 11(*a*) is a view showing the waste toner collection container 35 with the lid 17 held thereon, and FIG. 11(*b*) is a view showing the waste toner collection container 35 with the lid 17 attached thereto.

In the fifth embodiment, as shown in FIG. 11(*b*), a protrusion 42 is formed on the upper plate of the waste toner collection container 35 for engaging the lid 17. As shown in FIG. 11(*a*), the lid 17 is formed in a U-character shape, and one side portion thereof engages the protrusion 42, so that the lid 17 is rotatable around the protrusion 42. When the lid 17 closes the opening portion 36 of the waste toner collection container 35, the lid 17 is rotates around the protrusion 42, so that the other side portion of the lid 17 moves to a position corresponding to the opening portion 36 of the waste toner collection container 35, thereby closing the opening portion 36.

Sixth Embodiment

A sixth embodiment of the present invention will be explained next. Components in the sixth embodiment similar to those in the first to fifth embodiments are designated by the same reference numerals, and explanations thereof are omitted. Further, explanations of operations and effects in the sixth embodiment similar to those in the first to fifth embodiments are omitted.

Figure 12:
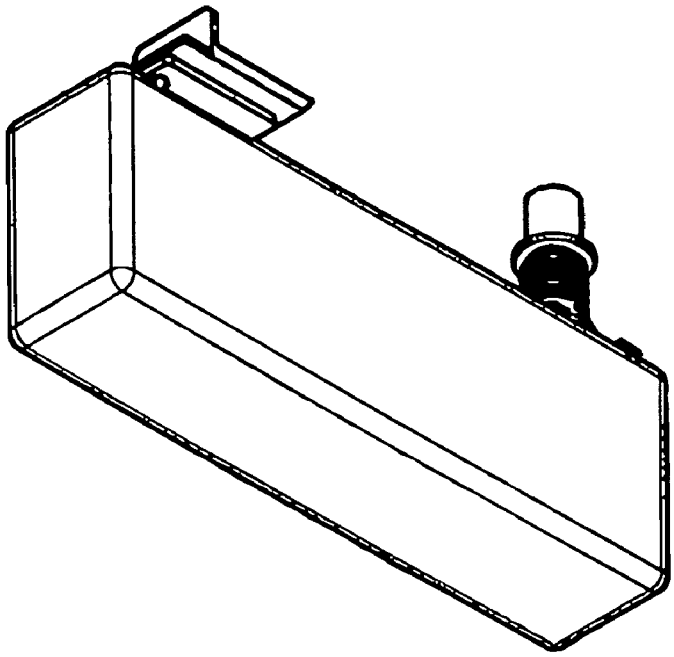
FIGS. 12(*a*) and 12(*b*) are perspective views showing a waste toner collection container according to a sixth embodiment of the present invention, wherein FIG. 12(*a*) is a view showing the waste toner collection container with a lid held thereon, and FIG. 12(*b*) is a view showing the waste toner collection container with the lid attached thereto.
Figure 12:
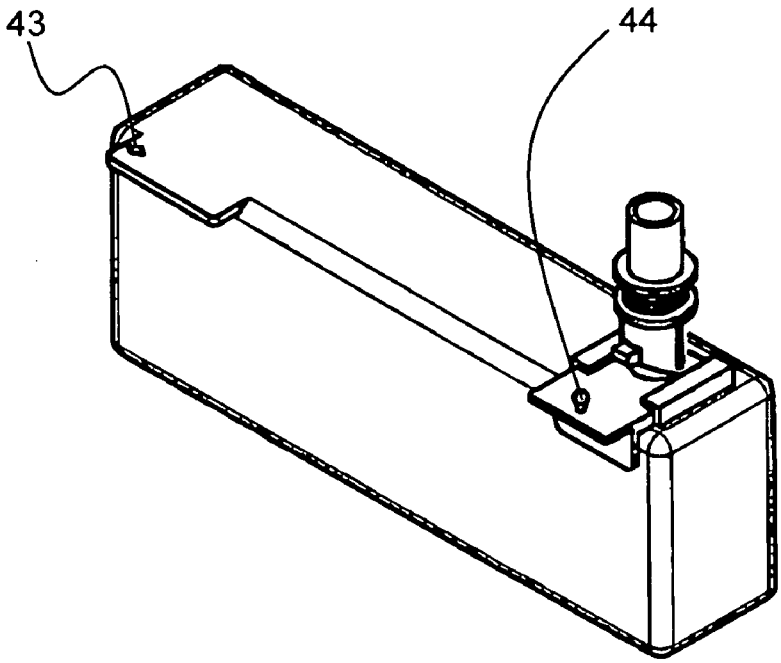

FIGS. 12(*a*) and 12(*b*) are perspective views showing the waste toner collection container 35 according to the sixth embodiment of the present invention. More specifically, FIG. 12(*a*) is a view showing the waste toner collection container 35 with the lid 17 held thereon, and FIG. 12(*b*) is a view showing the waste toner collection container 35 with the lid 17 attached thereto.

In the sixth embodiment, as shown in FIG. 12(*b*), a part of the upper plate of the waste toner collection container 35 extends outwardly, and a hole 43 is formed in the part of the upper plate. As shown in FIGS. 12(*a*) and 12(*b*), a protrusion 44 is formed on the lid 17 for inserting into the hole 43. When the lid 17 closes the opening portion 36 of the waste toner collection container 35, the protrusion 44 of the lid 17 is removed from the hole 43, so that the lid 17 closes the opening portion 36 in a method similar to that in the first embodiment.

Seventh Embodiment

A seventh embodiment of the present invention will be explained next. Components in the seventh embodiment similar to those in the first to sixth embodiments are designated by the same reference numerals, and explanations thereof are omitted. Further, explanations of operations and effects in the seventh embodiment similar to those in the first to sixth embodiments are omitted.

Figure 13:
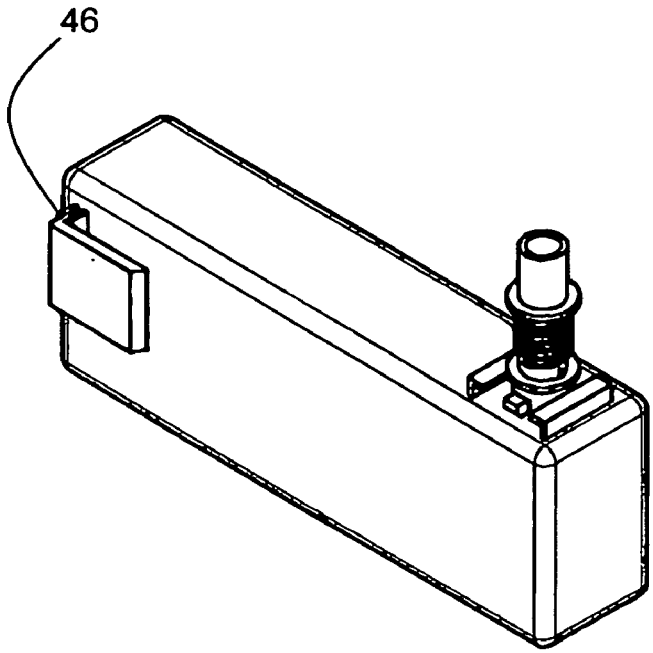
FIGS. 13(*a*) and 13(*b*) are perspective views showing a waste toner collection container according to a seventh embodiment of the present invention, wherein FIG. 13(*a*) is a view showing the waste toner collection container with a lid held thereon, and FIG. 13(*b*) is a view showing the waste toner collection container with the lid attached thereto.
Figure 13:
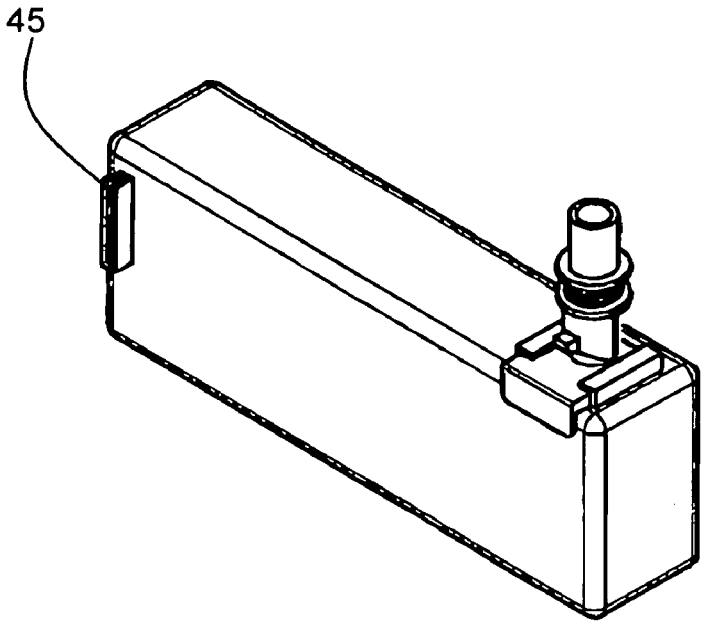

FIGS. 13(*a*) and 13(*b*) are perspective views showing the waste toner collection container 35 according to the seventh embodiment of the present invention. More specifically, FIG. 13(*a*) is a view showing the waste toner collection container 35 with the lid 17 held thereon, and FIG. 13(*b*) is a view showing the waste toner collection container 35 with the lid 17 attached thereto.

In the seventh embodiment, as shown in FIG. 13(*b*), a groove portion 45 is formed on the side plate of the waste toner collection container 35. As shown in FIG. 13(*a*), a bent portion 46 is formed on the lid 17 for inserting into the groove portion 45. When the lid 17 closes the opening portion 36 of the waste toner collection container 35, the bent portion 46 of the lid 17 is removed from the groove portion 45, so that the lid 17 closes the opening portion 36 in a method similar to that in the first embodiment.

Eighth Embodiment

An eighth embodiment of the present invention will be explained next. Components in the eighth embodiment similar to those in the first to seventh embodiments are designated by the same reference numerals, and explanations thereof are omitted. Further, explanations of operations and effects in the eighth embodiment similar to those in the first to seventh embodiments are omitted.

Figure 14:
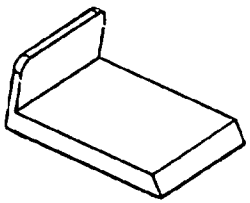
FIGS. 14(*a*) to 14(*d*) are perspective views showing a lid and a waste toner collection container according to an eighth embodiment of the present invention, wherein FIG. 14(*a*) is a view showing a top surface of the lid, FIG. 14(*b*) is a view showing a bottom surface of the lid, FIG. 14(*c*) is a view showing the waste toner collection container with the lid held thereon, and FIG. 14(*d*) is a view showing the waste toner collection container with the lid attached thereto.
Figure 14:
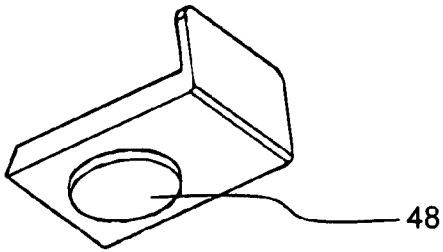
Figure 14:
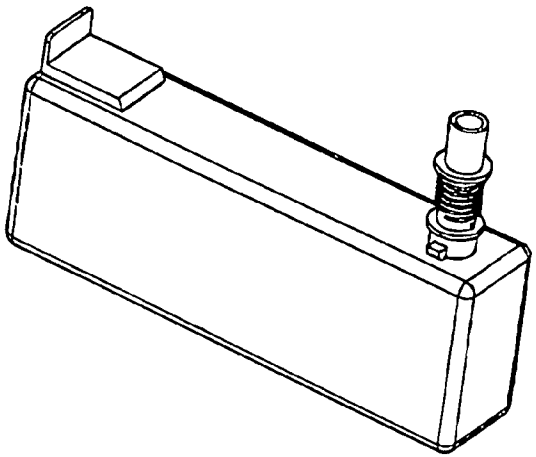
Figure 14:
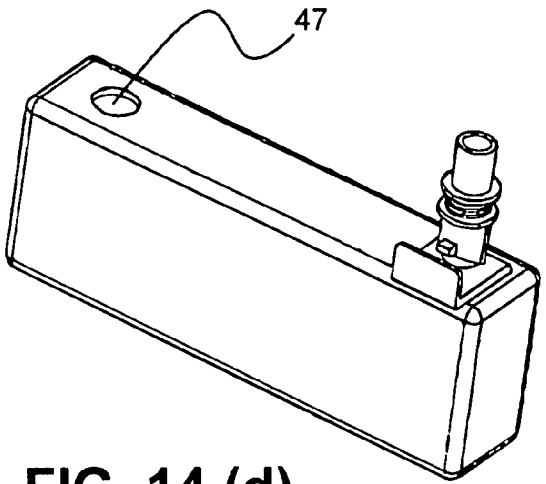

FIGS. 14(*a*) to 14(*d*) are perspective views showing the lid 17 and the waste toner collection container 35 according to the eighth embodiment of the present invention. More specifically, FIG. 14(*a*) is a view showing a top surface of the lid 17, FIG. 14(*b*) is a view showing a bottom surface of the lid 17, FIG. 14(*c*) is a view showing the waste toner collection container 35 with the lid 17 held thereon, and FIG. 14(*d*) is a view showing the waste toner collection container 35 with the lid 17 attached thereto.

Figure 15:
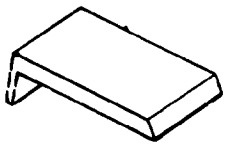
FIGS. 15(*a*) to 15(*d*) are perspective views showing a modified example No. 1 of the lid and the waste toner collection container according to the eighth embodiment of the present invention, wherein FIG. 15(*a*) is a view showing a top surface of the lid, FIG. 15(*b*) is a view showing a bottom surface of the lid, FIG. 15(*c*) is a view showing the waste toner collection container with the lid held thereon, and FIG. 15(*d*) is a view showing the waste toner collection container with the lid attached thereto.
Figure 15:
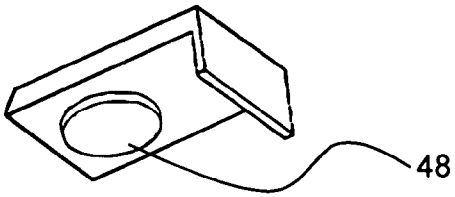
Figure 15:
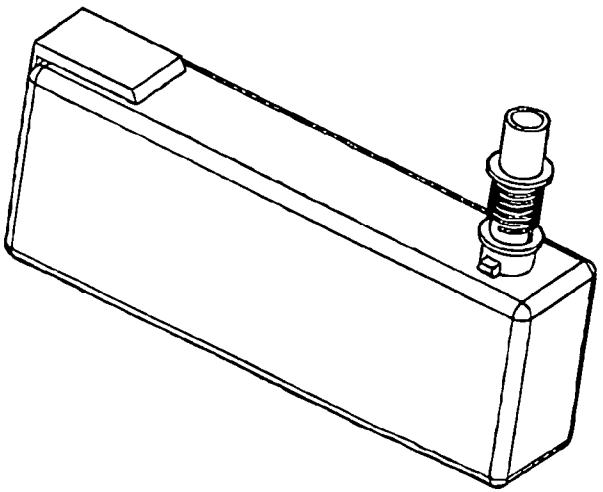
Figure 15:
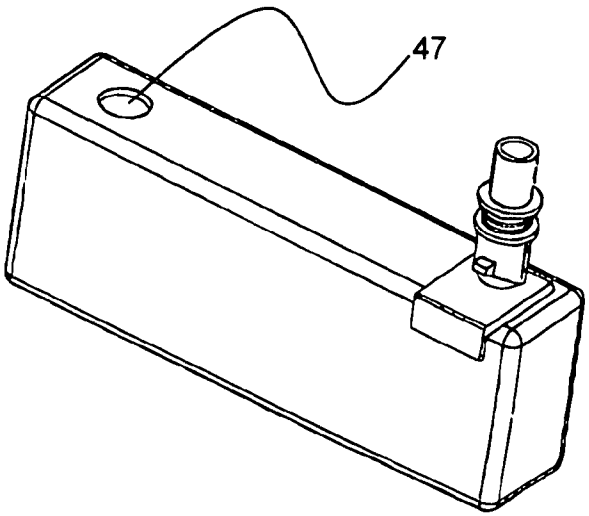

FIGS. 15(*a*) to 15(*d*) are perspective views showing a modified example of the lid 17 and the waste toner collection container 35 according to the eighth embodiment of the present invention. More specifically, FIG. 15(*a*) is a view showing a top surface of the lid 17, FIG. 15(*b*) is a view showing a bottom surface of the lid 17, FIG. 15(*c*) is a view showing the waste toner collection container 35 with the lid 17 held thereon, and FIG. 15(*d*) is a view showing the waste toner collection container 35 with the lid 17 attached thereto.

FIGS. 16(*a*) and 16(*b*) are perspective views showing a modified example No. 2 of the lid 17 and the waste toner collection container 35 according to the eighth embodiment of the present invention. More specifically, FIG. 16(*a*) is a view showing the waste toner collection container 35 with the lid 17 held thereon, and FIG. 16(*b*) is a view showing the waste toner collection container 35 with the lid 17 attached thereto.

Figure 17:
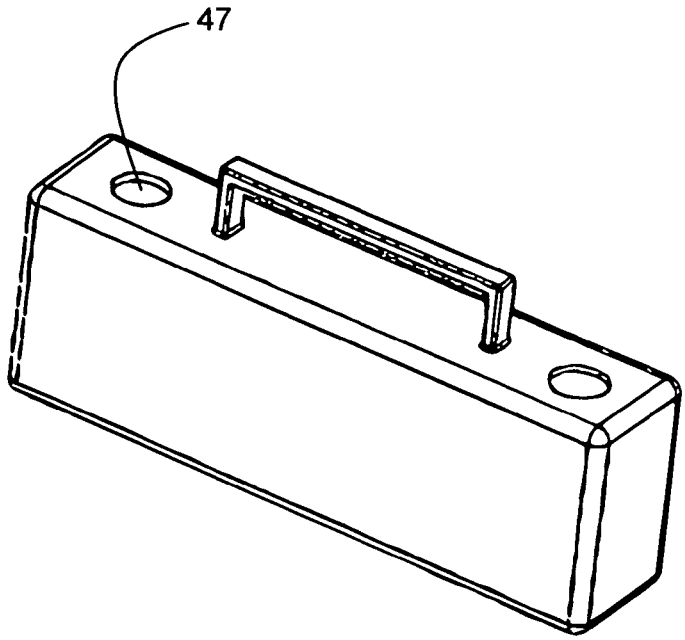
FIGS. 17(*a*) and 17(*b*) are perspective views showing a modified example No. 3 of the waste toner collection container according to the eighth embodiment of the present invention, wherein FIG. 17(*a*) is a view showing the waste toner collection container with a handle No. 1 , and FIG. 17(*b*) is a view showing the waste toner collection container with a handle No. 2.
Figure 17:
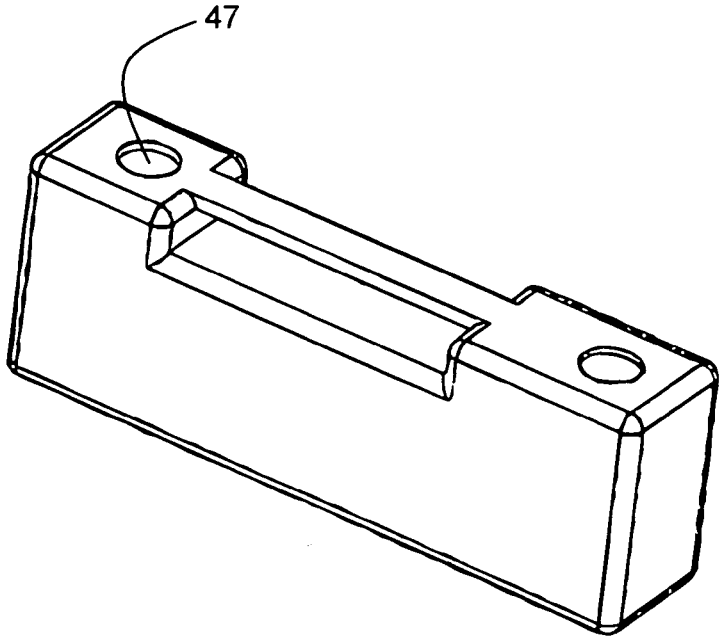
Figure 18:
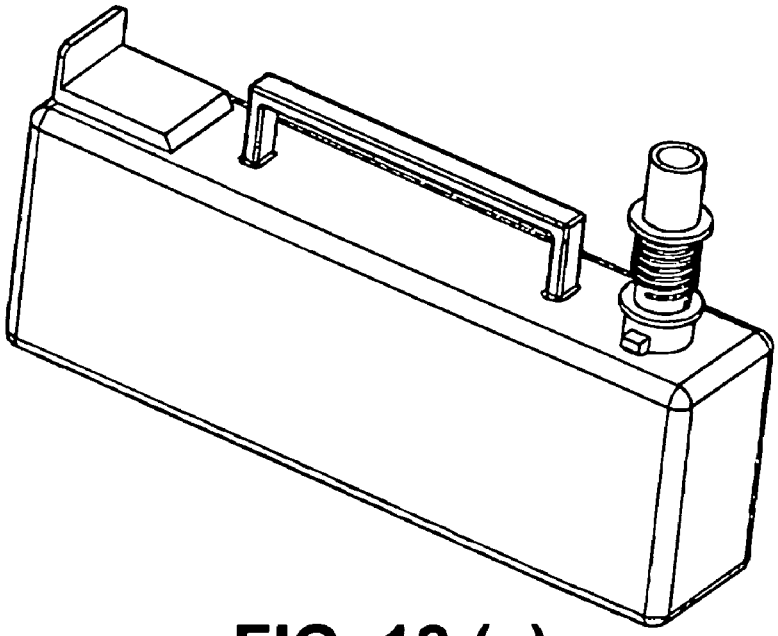
FIGS. 18(*a*) and 18(*b*) are perspective views showing a modified example No. 4 of the lid and the waste toner collection container according to an eighth embodiment of the present invention, wherein FIG. 18(*a*) is a view showing the waste toner collection container with the handle No. 1 and the lid held thereon, and FIG. 18(*b*) is a view showing the waste toner collection container with the handle No. 1 and the lid attached thereto.
Figure 18:
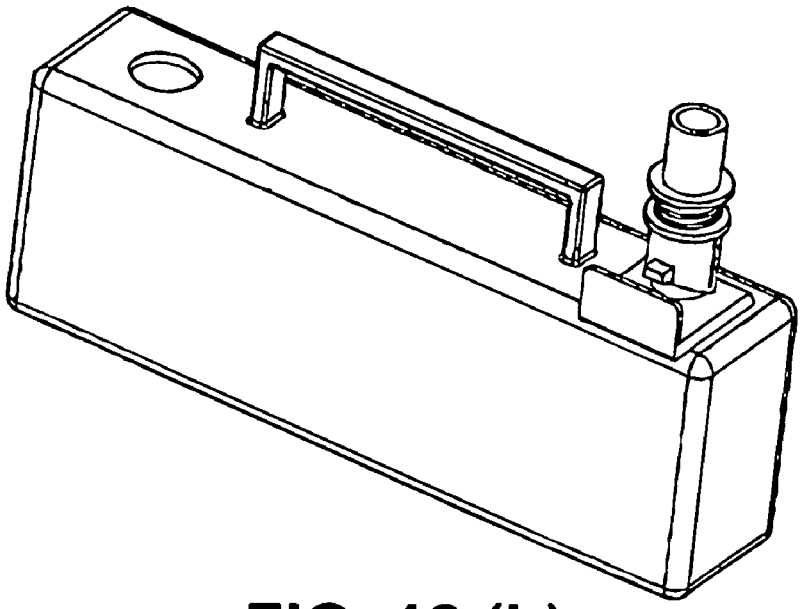

FIGS. 17(*a*) and 17(*b*) are perspective views showing a modified example No. 3 of the waste toner collection container 35 according to an eighth embodiment of the present invention, wherein FIG. 17(*a*) is a view showing the waste toner collection container 35 with a handle No. 1, and FIG. 17(*b*) is a view showing the waste toner collection container 35 with a handle No. 2; and FIGS. 18(*a*) and 18(*b*) are perspective views showing a modified example No. 4 of the lid 17 and the waste toner collection container 35 according to an eighth embodiment of the present invention, wherein FIG. 18(*a*) is a view showing the waste toner collection container 35 with the handle No. 1 and the lid 17 held thereon, and FIG. 18(*b*) is a view showing the waste toner collection container 35 with the handle No. 1 and the lid 17 attached thereto.

In the embodiment, as shown in FIGS. 14(*d*), 15(*d*), 16(*b*), 17(*a*), and 17(*b*), a recess portion 47 is formed in the waste toner collection container 35. The recess portion 47 has a shape substantially the same as that of the opening portion 36 of the waste toner collection container 35.

More specifically, as shown in FIGS. 14(*d*) and 15(*d*), the recess portion 47 is formed in the upper plate of the waste toner collection container 35. Alternatively, the recess portion 47 may be formed in the side plate of the waste toner collection container 35 near the discharge toner guide 15, as shown in FIG. 16(*b*). When the waste toner collection container 35 has a handle as shown in FIG. 17(*a*) or FIG. 17(*b*), it is preferred that the recess portion 47 is formed at a position near the handle, so that an operator easily recognizes the recess portion 47. Note that the recess portion 47 is formed as a recess, not a hole, with respect to the waste toner collection container 35.

In the embodiment, the lid 17 has a convex portion 48 corresponding to the opening portion 36 of the waste toner collection container 35. The convex portion 48 has a shape equal to or slightly larger than that of the opening portion 36.

In the embodiment, when the waste toner collection container 35 is attached to the main body of the image forming apparatus 10, the convex portion 48 of the lid 17 is fitted in the recess portion 47 of the waste toner collection container 35. When the opening portion 36 of the waste toner collection container 35 is closed, the lid 17 is detached from the recess portion 47. Then, the lid 17 slides on the opening portion 36 to close the opening portion 36. At last, the convex portion 48 of the lid 17 is fitted in the opening portion 36, thereby closing the opening portion 36.

As described above, in the fourth to eighth embodiments, it is possible to attach the lid 17 to the waste toner collection container 35. Accordingly, it is possible to prevent the lid 17 from being lost.

In the eighth embodiment, the lid 17 may engage any member or portion on the waste toner collection container 35, as far as the member or portion is formed on the surface of the waste toner collection container 35.

In the embodiments described above, the lid 17 is held on the waste toner collection container 35. Alternatively, the lid 17 may be held on the main body of the image forming apparatus 10, for example, a backside of the decorative plate of the image forming apparatus 10 or a portion near the position of the waste toner collection container 35, with one of the methods described above.

The disclosure of Japanese Patent Application No. 2007-083822, filed on Mar. 28, 2007 is incorporated in the application by reference.

While the invention has been explained with reference to the specific embodiments of the invention, the explanation is illustrative and the invention is limited only by the appended claims.

What is claimed is:

1. An image forming apparatus comprising:

a developer storage portion for storing developer, said developer storage portion having an opening portion and a closing member for closing the opening portion; and a developer supply portion for supplying developer through the opening portion, said developer supply portion being separated from the opening portion according to a movement of the closing member when the closing member moves to close the opening portion.

2. The image forming apparatus according to claim 1, wherein said developer storage portion includes a guide portion for guiding the closing member, said developer supply portion being pulled out from the developer storage portion when the closing member is guided with the guide portion to close the opening portion.

3. The image forming apparatus according to claim 1, wherein said developer supply portion includes a slant portion abutting against the closing member.

4. The image forming apparatus according to claim 1, wherein said developer storage portion is capable of being detached from the image forming apparatus when the closing member is attached to the developer storage portion.

5. The image forming apparatus according to claim 1, wherein said developer supply portion is arranged to move to the opening portion while contacting with the developer storage portion when the developer storage portion is attached to the image forming apparatus.

6. The image forming apparatus according to claim 5, wherein said developer supply portion includes a slant portion at a distal end portion thereof, said developer storage portion including a chamfer portion for abutting against the slant portion when the developer storage portion is attached to the image forming apparatus.

7. The image forming apparatus according to claim 5, wherein said developer supply portion includes a discharge outlet for discharging developer to the developer storage portion, a shutter member for closing and opening the discharge outlet, and a plate member for abutting against an end portion of the shutter member, said plate member being arranged to push the end portion of the shutter member to open the discharge outlet when a distal end portion of the developer supply portion is inserted into the opening portion.

8. The image forming apparatus according to claim 7, wherein said closing member is arranged to move the shutter member so that the shutter member closes the discharge outlet when the closing member is attached to the developer storage portion.

9. A developer storage unit for storing developer, comprising:

an opening portion;

a closing member for closing the opening portion;

a guide portion that engages with the closing member for guiding the closing member to the opening portion so that the closing member moves along the guide portion in a direction parallel to an opening surface of the opening portion; and a holding portion for holding the closing member at least in a state that the guide portion does not engage with the closing member.

10. The developer storage unit according to claim 9, wherein said closing member is detachably attached to a surface of the developer storage unit.

11. The developer storage unit according to claim 10, wherein said holding portion includes a protrusion in a claw shape formed on the surface of the developer storage unit.

12. The developer storage unit according to claim 9, wherein said holding portion is formed on the surface of the developer storage unit, and includes a connecting portion connected to the surface of the developer storage unit.

13. The developer storage unit according to claim 12, wherein said connecting portion includes a bendable member or a breakable member through twisting.

14. The developer storage unit according to claim 12, further comprising an engagement claw for engaging the closing member with the surface of the developer storage unit.

15. The developer storage unit according to claim 9, wherein said holding portion includes a protrusion formed on the surface of the developer storage unit, said closing member including an insertion hole for receiving the protrusion.

16. The developer storage unit according to claim 9, wherein said holding portion includes a protrusion formed on the surface of the developer storage unit, said closing member including one end portion supported on the protrusion so that the closing member is rotatable around the protrusion, said closing member including the other end portion facing the opening portion when the closing member rotates.

17. The developer storage unit according to claim 9, wherein said holding portion includes a hole formed in a plate member extending from the surface of the developer storage unit, said closing member including a protrusion inserted into the hole.

18. The developer storage unit according to claim 9, wherein said holding portion includes a groove portion formed in the surface of the developer storage unit, said closing member including a protrusion for engaging the groove portion.

19. The developer storage unit according to claim 9, wherein said holding portion includes a recess portion formed in the surface of the developer storage unit, and said closing member includes a convex portion having a shape corresponding to that of the recess portion.

20. The developer storage unit according to claim 9, wherein said holding portion is formed on a surface where the opening portion is formed, or is formed near the opening portion on another surface adjacent to the surface where the opening portion is formed.

21. The developer storage unit according to claim 9, further comprising a handle portion.

22. An image forming apparatus comprising:

a developer storage portion for storing developer, said developer storage portion having an opening portion, a closing member for closing the opening portion, a guide portion that engages with the closing member for guiding the closing member to the opening portion, and a holding portion for holding the closing member at least in a state that the guide portion does not engage with the closing member, wherein said closing member is arranged to move along the guide portion in a direction parallel to an opening surface of the opening portion.

* * * * *